United States Patent [19]

Tzou

[11] Patent Number: 4,982,587

[45] **Date of Patent: * Jan. 8, 1991**

[54] ELECTRONICALLY SELF-LATCHING CYLINDER LOCK

[76] Inventor: Kae M. Tzou, 3 Fl., No. 181, Sec. 5, Chung Hsiao E. Rd., Taipei, Taiwan

[ * ] Notice: The portion of the term of this patent subsequent to Sep. 4, 2007 has been disclaimed.

[21] Appl. No.: 507,479

[22] Filed: Apr. 11, 1990

[51] Int. Cl.[5] ..... E05B 49/00

[52] U.S. Cl. ..... 70/492; 70/277; 70/283; 70/441; 70/DIG. 49

[58] Field of Search ..... 70/441, 492, 277, 278, 70/419, DIG. 49, 416, 283

[56] References Cited

U.S. PATENT DOCUMENTS 1,789,754 1/1931 Jacobi ..... 70/492
3,889,501 6/1975 Fort ..... 70/283
4,712,398 12/1987 Clarkson ..... 70/283
4,848,115 7/1989 Clarkson ..... 70/283

*Primary Examiner*—Robert L. Wolfe
*Attorney, Agent, or Firm*—Morton J. Rosenberg; David I. Klein

[57] ABSTRACT

An electronically self-latching cylinder lock comprising a cylinder into which a plug is inserted, a plurality of paired pin tumblers each of which is disposed in one of a plurality of bores formed inside the cylinder and the plug, and a plurality of switches which are controlled by the pin tumblers. The switches are used to actuate an electronic circuit to send out warnings with a buzzer and to secure the plug at its locked position with a latch which is driven with a solenoid, when an incorrect key is inserted into the key way.

8 Claims, 8 Drawing Sheets

ELECTRONICALLY SELF-LATCHING CYLINDER LOCK

BACKGROUND OF THE INVENTION

The present invention relates generally to cylinder locks and especially to a cylinder lock with self-latching means.

Cylinder locks have wide applications in everyday life. The importance of the cylinder locks is evident. The conventional cylinder lock, however, has a major disadvantage. That is, it can be unlocked by using suitable tools, such as picks.

SUMMARY OF THE INVENTION

It is therefore a feature of the subject invention to provide a cylinder lock which, if not opened with a correct key, will actuate a self-latching means to latch the plug thereof and prevent the plug from being rotated.

It is another feature of the present invention to provide a cylinder lock which sends out warnings when the key way thereof is inserted by incorrect keys or picks.

It is a further feature of the present invention to provide a cylinder lock incorporating with self-latching device which can replaces the conventional cylinder locks without modifying the lock bore inside which the cylinder lock is installed.

Other features and advantages of the present invention will be apparent from the following description taken in conjunction with the accompanying drawings, in which like reference numerals designate the same or similar parts throughout the figures thereof.

BRIEF DESCRIPTION OF THE DRAWINGS

FIGS. 11 and 12 show a conventional cylinder lock wherein FIG. 12 shows a key inserted in the key way.

DETAILED DESCRIPTION OF THE PREFERRED EMBODIMENT

Figure 11:
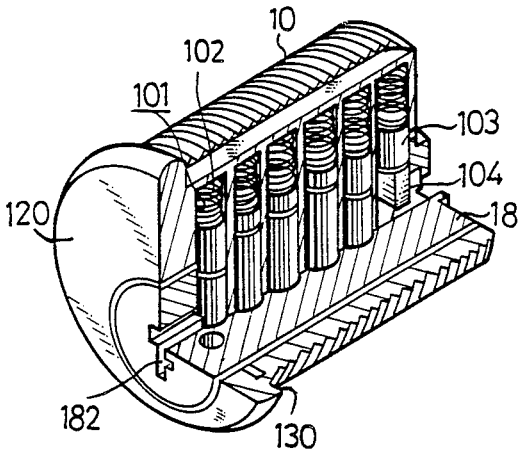
FIG. 11 PRIOR ART
Figure 12:
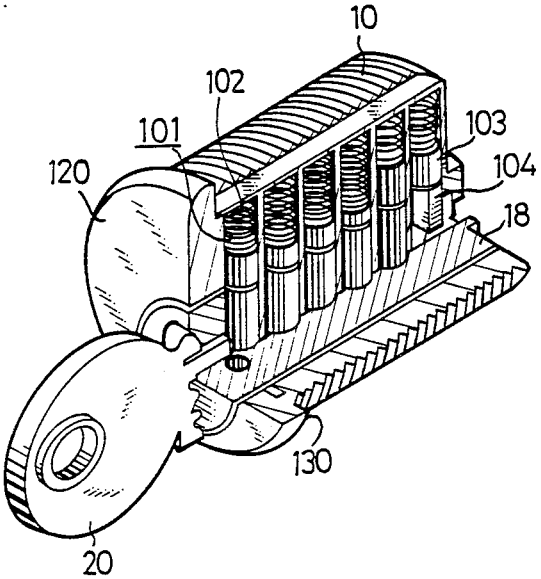
FIG. 12 PRIOR ART

Referring to FIGS. 11 and 12, wherein a conventional cylinder lock is shown, a cylinder lock comprises a cylinder 10 and a lock face 120 which has a diameter larger than that of the cylinder 10 and which is formed at an end of said cylinder 10 so as to form a shoulder 130 between cylinder 10 and the lock face 120. The shoulder 130 abuts the edge of a lock bore (not shown) in which the cylinder lock is installed. A plug 18 with a key way 182 is eccentrically inserted into the cylinder 10. A plurality of spring-loaded pin tumblers are disposed inside a plurality of bores 101 formed in the cylinder 10 and extending to the key way 182 to constrain the rotation of the plug 18 so as to secure the plug 18 at the locked position. Each of the pin tumbler is constituted by an upper portion 103 and a lower portion 104 which are not fixed together, but contacting each other. When a key 20 is inserted into the key way 182, the pin tumblers are moved away from the key way 182. With the contacting surface of the upper portion 103 and the lower portion 104 in alignment with the interface between the plug 18 and the cylinder 10, the plug 18 is rotatable to the unlocked position.

Figure 1:
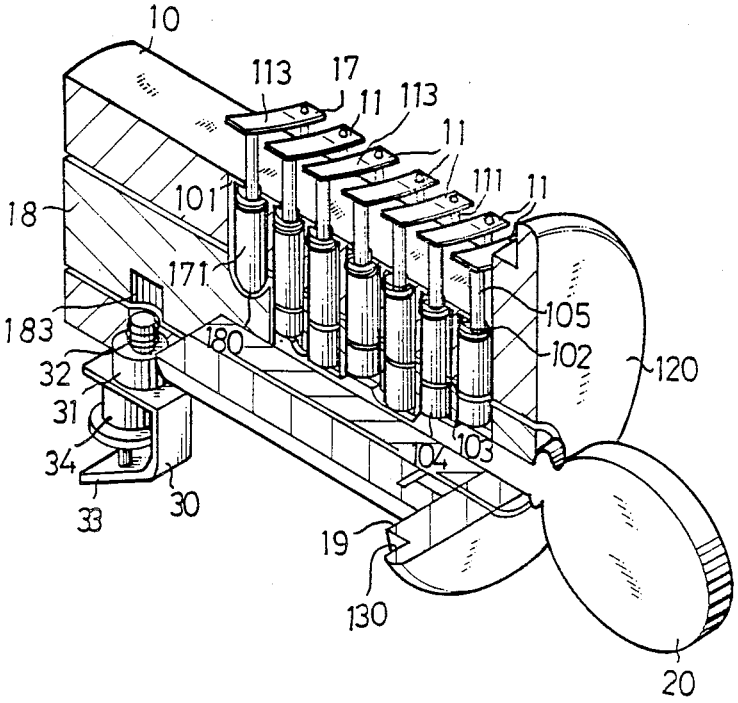
FIG. 1 shows a perspective view of an embodiment of the cylinder lock in accordance with the present invention with part of the cylinder being taken away to show the inside construction.
Figure 2:
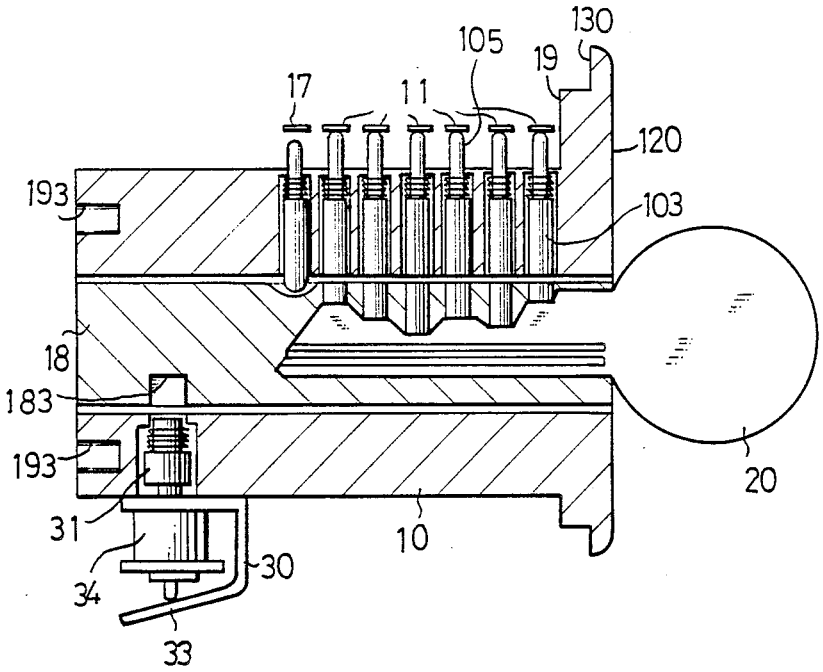
FIG. 2 is the sectional view of the cylinder lock shown in FIG. 1.

Referring now to FIGS. 1 and 2, the cylinder lock in accordance with the present invention comprises a plurality of switches 11 each of which is associated with one of the pin tumblers. Each of the switches 11 includes a spike 105 fixed on the upper portion 103 of the associated pin tumbler, running through a helical spring 102, and protruding out of the cylinder 10. The spring 102 is so disposed between the upper portion 103 and the inside surface of the cylinder 10 that it bias the pin tumbler into the bore 101. Each spike 105 is associated with a piece of strip-like resilient conductor 113 which is fixed on the cylinder 10 via an insulator 111. The conductor 113 is electrically connected to an electronic circuit (See FIG. 3) to be described later via an electric wire or the like (not shown). The resilient conductor 113 is so disposed that when the pin tumbler is moved away from the key way 182, the spike 105 will contact the resilient conductor 113 to form an electrical closed loop.

The cylinder lock in accordance with the present invention is so dimensioned that the largest diameter of the cylinder 10 is less than the inside diameter of a lock bore (not shown) wherein the cylinder lock is inserted. A shoulder 19 with the same diameter as the lock bore is further defined between the shoulder 130 and the cylinder 10 so that when the cylinder lock is installed, the shoulder 19 firmly abuts a edge of the lock bore. To securely fix the cylinder lock inside the lock bore, a plurality of threaded holes are form on the remote end of the cylinder 10 from the lock face 120. The cylinder lock therefore can be fixed by means of screws or the like (not shown).

There is another switch 17 corresponding to a control pin 171. The construction of the switch 17 is the same as the other switch 11, but the control pin 171, instead of being constituted by an upper portion and a lower portion as the pin tumblers, is constituted by only one piece and is disposed in a bore formed inside the cylinder 10. The lower end of the pin 171 is disposed in a slot 180 formed on the surface of the plug 18. The slot 180 is so formed that when the plug 18 is rotated, the slot 180 will be inclined and the pin 171 be pushed upwards along the slot 180 and as a result, the spike associated therewith will contact the resilient conductor of the switch 17.

The cylinder lock in accordance with the present invention further comprises a self-latching means 30 which comprises a latching means 31, such as a latch, in connection with a driving means 34, such as a solenoid, disposed in the cylinder 10 and a hole 183 formed in the plug 18 to receive the latch 31 therein when the latch 31 is moved toward it. The latch 31 which is biased by a spring 32 to be away from the hole 183 is disposed on a movable seat 33 which is made of ferromagnetic material and is so shaped that when the solenoid is energized, the movable seat 33 will be attracted, pushing the latch 31 forwards into the hole 183 so as to secure the plug 18 at the locked position.

Figure 3:
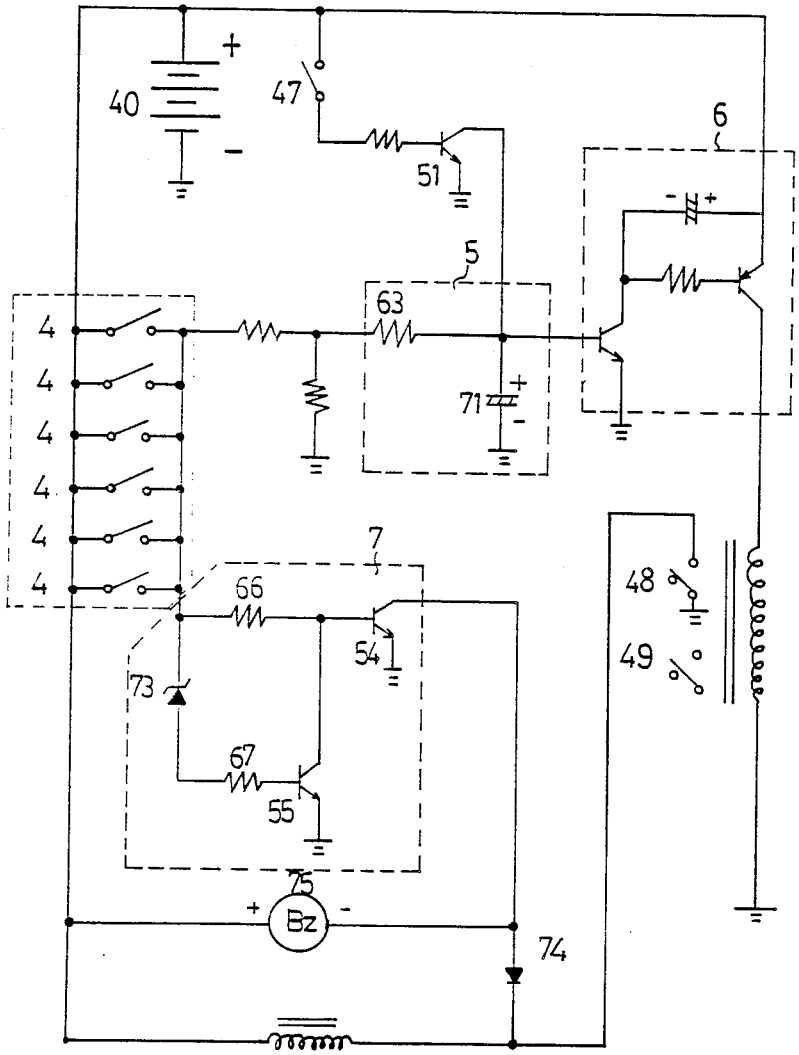
FIG. 3 shows the circuit of the present invention associated with the embodiment shown in FIG. 1.
Figure 4:
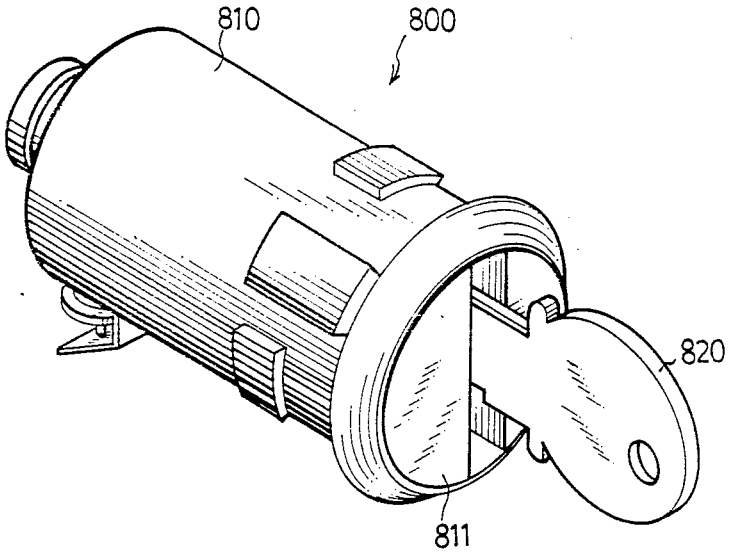
FIG. 4 shows a perspective view of another embodiment of the present invention which is basically an ignition lock for automobiles.

Referring now to FIG. 3, the circuit of the present invention comprises a battery set 40, a plurality of switches 4 associated with the switches 11 constituted by the resilient conductors 113, an integration circuit 5, which is constituted by a resistor 63 and a capacitor 71, and a triggering circuit 6. The switches 4 has a common output which is connected to both the integration circuit 5 and a battery testing circuit 7. The output of the integration circuit 5 is connected to the triggering circuit 6 which is in turn connected to a relay. The relay controls a switch 48 to which a buzzer 75 and the solenoid 34 are connected. The output of the integration circuit 5 is also grounded via a transistor 51 which is controlled by a switch 47.

The circuit operates as follows: When an incorrect key or a pick is inserted into the key way 182, one or more of the pin tumblers will be moved away from the key way 182 and the associated switch(s) 4 will be closed so that the capacitor 71 of the integration circuit 5 will be charged. After a time interval determined by the elements of the integration circuit 5, the capacitor 71 will be charged to some extent and the triggering circuit 6 will be actuated by the output of the integration circuit 5. As a result, the switch 48 is closed, the buzzer 75 sounds, and the solenoid 34 is energized. With the solenoid 34 energized, the latch 31 is forced to move into the hole 183 and secure the plug 18 from being rotated. If a correct key is inserted into the key way 182 and the plug 18 is rotated within the time interval given by the integration circuit 5, besides the switches 4, the switch 47 is also closed due to the rotation of the plug 18. Because switch 47 is closed, transistor 51 will be turned on. Under this situation, the capacitor 71 discharges through transistor 51 and the triggering circuit 6 will not be actuated. As a result, the plug 18 can be continously rotated by the key 20 to the unlocked position without actuating the buzzer 75 to send out warnings.

The circuit of the present invention further comprises a battery testing circuit 7 which is constituted by a Zenen diode 73, two resistors 66 and 67, and two transistors 54 and 55. When the voltage of the battery set 40 drops to a lever lower than the Zener voltage of the Zener diode 73, the transistor 54 will become conducted and the buzzer 54 will sound to indicate that the voltage of the battery set 40 has become lower than necessary.

In accordance with the circuit shown in FIG. 3, it can be observed that there is no difference that which kind of combination of the switches 11 are turned on and it is thus possible to connect the resilient conductors 113 together side by side to form a large piece of common conductor which is contactable by all the spikes 105 associated with the pin tumbers, without affecting the intended results of the present invention.

Figure 5:
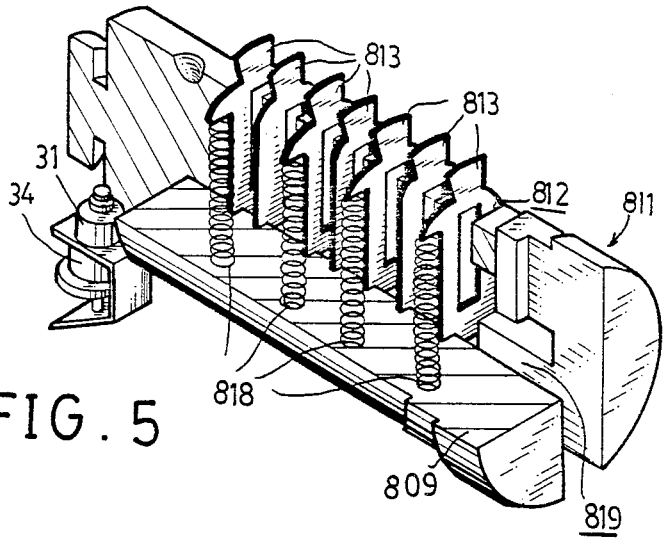
FIG. 5 shows a perspective view of the plug of the embodiment shown in FIG. 4 with part thereof being taken away to show inside construction.
Figure 6:
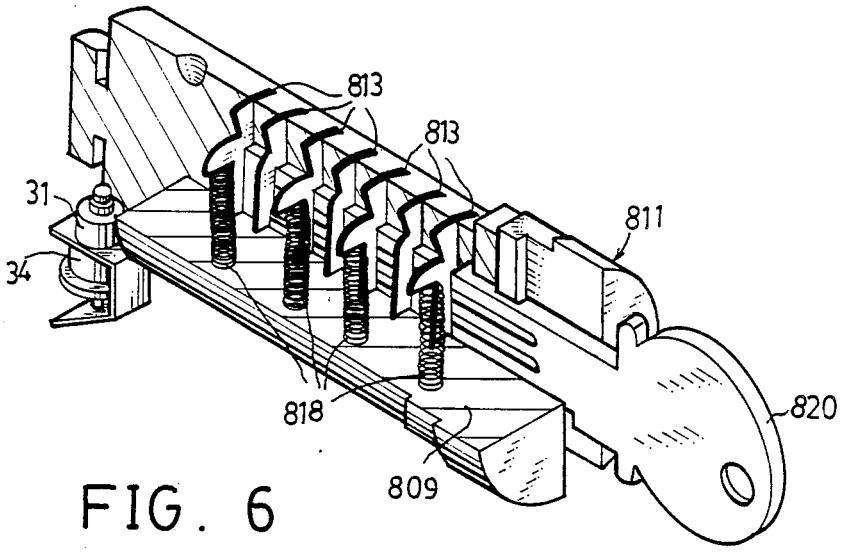
FIG. 6 shows another perspective view of the same embodiment shown in FIG. 4 with a key inserted into the key way thereof.
Figure 7:
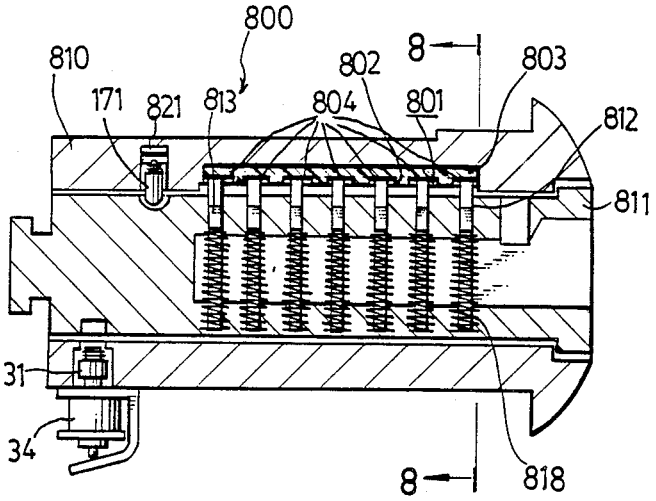
FIG. 7 is a cross sectional view of the embodiment shown in FIG. 4.
Figure 8:
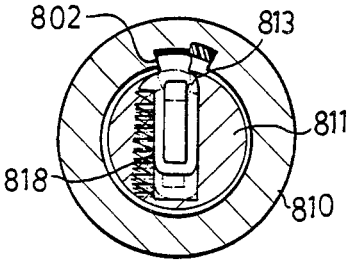
FIG. 8 is a cross sectional view taken along line 8—8 of FIG. 7.
Figure 9:
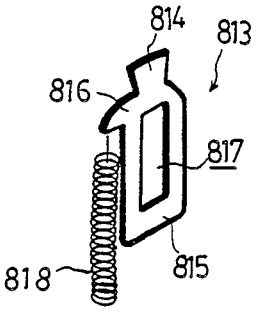
FIG. 9 shows a perspective view of a sliding piece associated with the embodiment shown in FIG. 4.

Referring now to FIGS. 4 to 8, wherein another embodiment further extending the principle of the present invention is shown, a cylinder lock 800, which is basically a lock for automobile ignition system, is constituted by a cylinder 810 into which a plug 811 with a plurality of openings 812 radially running therethrough is inserted. Inside each of the opening 812, a sliding piece 813 is inserted to serve as the pin tumblers of a conventional cylinder lock. Referring to FIG. 9, wherein a sliding piece 813 is shown, a sliding piece 813 is constituted by an upper portion 814, a lower portion 815 through which a slot 817 is running, and a lug 816 which are fixed together. A spring 818 is disposed between each of the lugs 816 and a shoulder 809 of the plug 811 so as to bias the sliding piece 813 partially out of the openings 812. With the sliding pieces 813 partially protruding out of the plug 811, the plug 811 will be kept from rotating with the upper portion 814 of the sliding pieces 813 being abutted by an internal longitudinal shoulder 802 of the cylinder 810. The orientation of said lugs 816 may either be in different directions as shown in FIGS. 5 and 6, or in the same direction as shown in FIGS. 7 and 8. Referring particularly to FIG. 8, the cylinder 810 has at least one internal groove 801 running longitudinal through the cylinder 810 and constituting the abutting shoulder 802. Inside the groove 801, an insulator seat 803 with a plurality of resilient conductors 804 is disposed. Each of the resilient conductors 804 is associated with one of the sliding pieces 813 which is normally biased upward to contact the resilient conductors 804 so as to form an electrical closed loop.

Similar to the embodiment shown in FIGS. 1 and 2, there is also a control pin 171. If one or more of the sliding pieces 812 is pulled down and not contacting the resilient conductors 804 while the control pin 171 is not moved to contact its associated conductor 821 within a pre-set period determined by an electronic circuit to be further described hereinafter, a latch 31 which is similar to that shown in FIG. 1 will be driven by a driving means 34 to keep the plug 811 from being rotated. Also similar to the embodiment shown in FIGS. 1 and 2, each sliding piece 813 is connected to a switch (formed by the associated resilient conductor 804) which is normally closed when the sliding pieces 811 is partially out of the opening 812 and will be opened when the sliding pieces 811 are pulled down into the openings 812. When the situation is the same as FIG. 5, the switches are closed, while in FIG. 6, the switches are open. There is also a switch associated with the control pin 171. This switch formed by a resilient conductor 821, is normally open when the plug 811 is in the locked position.

The slots 817 form part of the key way 819 through which a key 20 is insertable. When the key 20 is inserted into the key way 819 and passes through the slots 817 of the sliding pieces 813, the sliding pieces 813 are forced down against the biasing spring 818 until completely entering into the openings 812, thus allowing the plug 811 to be rotated by the key 820. Similar to the previous embodiment, when the plug 811 is rotated, the control pin 171 will be moved to contact the resilient conductor 821 and thus closing the switch associated therewith.

Figure 10:
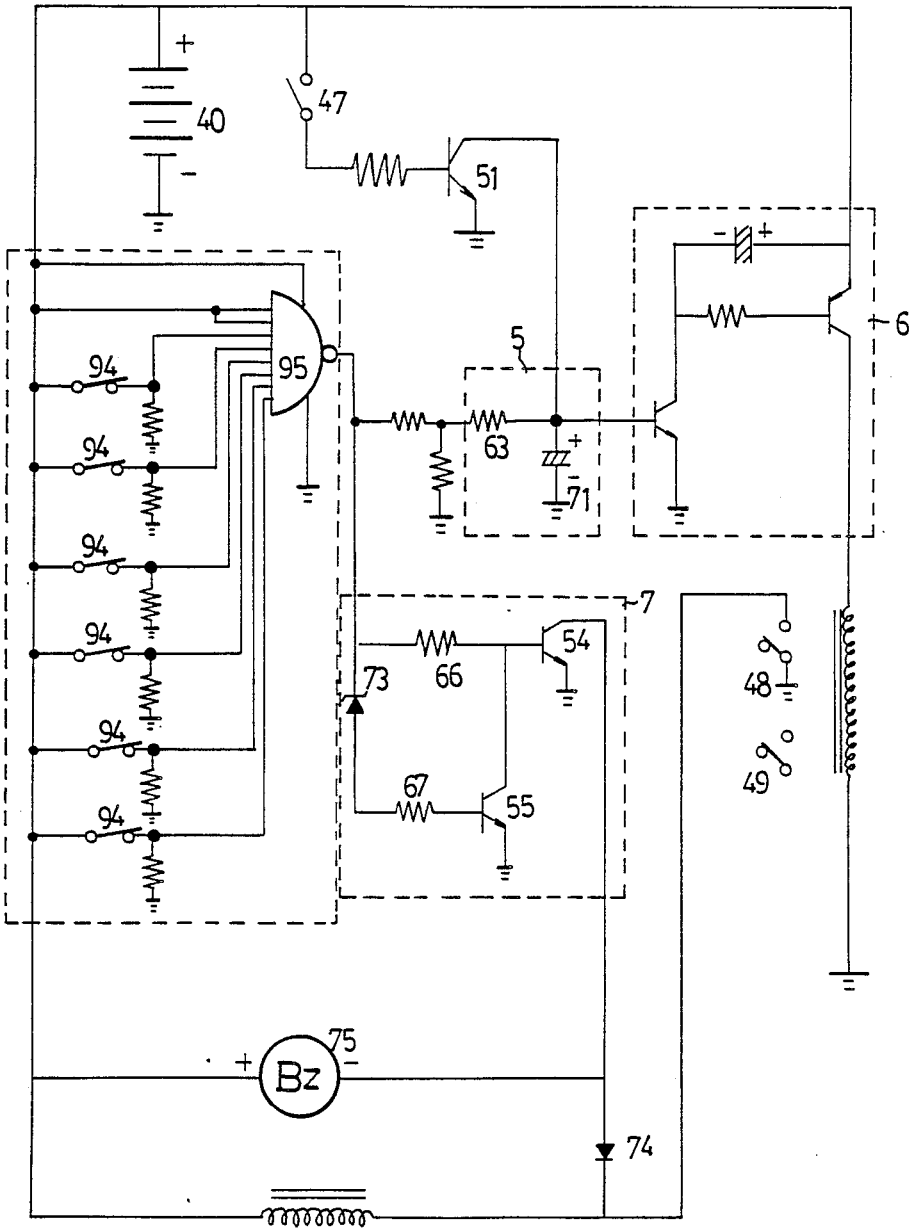
FIG. 10 shows the circuit associated with the embodiment shown in FIG. 4.

Referring now to FIG. 10, a circuit associated the embodiment shown in FIGS. 4 to 8 is shown. The circuit is similar to that shown in FIG. 3 except that the normally open switches 4 are replaced with a set of normally closed switches 94 and a NAND gate 95 connected in seires with the common output of the switches 94. Each of the switches 94 corresponds to one of the switches associated with the sliding pieces 813 while switch 47 corresponds to the switch associated with the control pin 171. When one of the switches 94 is open (i.e. its associated sliding piece 813 is pulled into the plug 811), the NAND gate 95 will output a positive voltage other than zero and thus charging capacitor 71 of the integration circuit 5. If switch 47 is not closed (i.e. the control pin 171 is not moved to contact the conductor 821 in a pre-set time interval determined by the integration circuit 5 to discharge the capacitor 71, the self-latching means 30 will be actuated. Thus, the latch 31 is driven by the driving means 34 to enter the hole 183 and prevent the plug 811 from being rotated. The circuit shown in FIG. 7 also comprises a battery set 40, a triggering circuit 6, a buzzer 75, a battery testing circuit 7 and other parts, and is basically similar to that shown in FIG. 3. No further description will be given.

The foregoing is considered illustrative only of the principles of the invention. Further, since numerous modifications and changes will readily occur to those skilled in the art, it is not desired to limit the invention to the construction and operation described above and the invention disclosed herein is intended to cover all such modifications as fall within the scope of the appended claims.

I claim:

1. An electronically self-latching cylinder lock comprising a cylinder into which a plug with a key way is inserted, a plurality of pin tumblers each of which is disposed in one of a plurality of bores formed inside said cylinder as well as said plug and extending to said key way, a plurality of switches associated with said pin tumblers, a latching means, a warning means, and an electronic circuit which is controlled by said switches to drive said latch means and said warning means, and characterized in that:

each of said switches is constituted by a spike, which is fixed on an associated pin tumbler of said pin tumblers and protrudes out of said cylinder, and a resilient conductor which is fixed to said cylinder via an insulator so that when said spike is caused to move further out of said cylinder by said associated pin tumbler, said spike will contact said resilient conductor to form a closed electrical loop;

said cylinder lock further comprises a control pin which has an associated switch including a spike fixed on said pin and a resilient conductor fixed on said cylinder via an insulator and which is disposed inside a bore formed inside said cylinder with the lower end thereof contacting a slot formed on the surface of said plug so that when said plug is rotated, said slot will be inclined and said control pin will be driven to have said spike thereof contact said resilient conductor;

said latching means is so installed that when actuated by said electronic circuit, said latching means will latch said plug and prevent said plug from being rotated;

said warning means is so connected to said electronic circuit that when said latching means is actuated, said warning means is also actuated to send out warning signal;

said electronic circuit is so connected that when any one of said pin tumblers is moved to have the associated spike contact the associated resilient conductor, the latching means and the warning means will be actuated if the spike of said control pin does not contact its associated resilient conductor in a given time interval to disable the electronic circuit.

2. An electronically self-latching cylinder lock comprising a cylinder into which a plug with a plurality of openings radially running therethrough, a plurality of sliding pieces each of which is disposed inside one of said openings, a control pin which is also disposed inside a bore radially formed inside said cylinder, a latching means, a warning means, and an electronic circuit, each of said sliding pieces being constituted by an upper portion, a lower portion with a slot running therethrough and a lug with a spring attached thereon with one end, the other end of said spring being fixed on said plug so as to bias said sliding piece partially out of said plug to keep said plug from being rotated by abutting a shoulder of said cylinder, each of said sliding piece being associated with a resilient conductor which is fixed on said cylinder via a common insulator, said insulator, together with said resilient conductors being disposed in a longitudinal slot formed on the internal surface of said cylinder so that when said sliding pieces are partially out of the openings, they will contact said resilient conductors and when said sliding piece are pulled into said openings, they will loss contact with said conductors, said slots of the sliding pieces constituting part of a key way of said cylinder lock so that when key is inserted into said key way and passes through said slots, said sliding pieces will be pulled down into said plug completely to allow said plug to be rotated, said control pin contacting a slot formed on the surface of said plug so that when said plug is rotated, said control pin will be moved out of said cylinder along said slat to contact a resilient conductor, each of said sliding pieces being associated with a switch which is closed when the associated sliding piece is partially out of said plug and contact said resilient conductor associated therewith and which is open when the associated sliding piece fully enters into said plug, said control piece being associated with a switch which is closed when said control pin is moved out of said plug to contact the resilient conductor associated therewith and which is closed when said control pin fully enters into said plug, each of the switches being constituted by its associated sliding piece, including the control pin, and a resilient conductor which is attached to said insulator seat, said latching means being so installed that when actuated by said electronic circuit, said latching means will latch said plug and prevent said plug from being rotated, said waning means being so connected to said electronic circuit that when said latching means is actuated, said warning means is also actuated to send out warning signal, said electronic circuit being so connected that when any one of said sliding piece is moved into said plug so as to have its associated switch open and said plug is not rotated within a given time interval to have said control pin contact its associated resilient conductor, said electronic circuit will be triggered and thus actuating warning means.

3. An electronically self-latching cylinder lock as claimed in claim 1 or claim 2 wherein said latching means comprises a latch and a driving means which is fixed on said cylinder, said driving means being connected to said electronic circuit so that when said electronic circuit is triggered, said driving means will be actuated to drive said latch into a latch hole formed on said plug and thus preventing said plug from being rotated.

4. An electronically self-latching cylinder lock as claimed in claim 3 wherein said driving means is a solenoid and said latch is disposed on a ferromagnetic seat so that when said solenoid is energized, said seat will be moved by said solenoid to have said latch slide into said latch hole.

5. An electronically self-latching cylinder lock as claimed in claim 1 or 2 wherein said warning means is a means which sends out audio signal when actuated.

6. An electronically self-latching cylinder lock as claimed in claim 5 wherein said audio means is a buzzer.

7. An electronically self-latching cylinder lock as claimed in claim 1 wherein said electronic circuit comprises a battery set, a plurality of switches each of which is connected to one of said switches associated with said pin tumblers, a further switch which is connected to said switch associated with said control pin, an integration circuit which comprises basically resistors and capacitor so as to provide a time delay to the actuation of said latching means and said warning means, a triggering circuit which will actuate said latching means and said warning means via a relay when said electronic circuit is not disabled by opening said further switch associated with said control pin within the time interval given by said integration circuit, and a battery testing circuit which sends out warning signals via said warning means when the voltage level of said battery set drops to be lower than a pre-specified value.

8. An electronically self-latching cylinder lock as claimed in claim 2, wherein said electronic circuit comprises a battery set, said switches associated with said sliding pieces, said switch associated with said control pin, an integration circuit which comprises basically resistors and capacitor so as to provide a time delay to the actuation of said latching means and said warning means, a triggering circuit which will actuates said latching means and said warning means via a relay when said electronic circuit is not disabled by opening said further switch associated with said control pin within the time interval given by said integration circuit, and a battery testing circuit which sends out warning signals via said warning means when the voltage level of said battery set drops to be lower than a pre-specified value.

* * * * *